US006991541B2

(12) United States Patent
Lind et al.

(10) Patent No.: US 6,991,541 B2
(45) Date of Patent: Jan. 31, 2006

(54) LOTTERY TICKET DISTRIBUTION SYSTEM

(75) Inventors: Clifton Lind, Austin, TX (US); Gordon T. Graves, Austin, TX (US); Joseph R. Enzminger, Austin, TX (US); Jefferson C. Lind, Austin, TX (US); Gary L. Loebig, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 110 days.

(21) Appl. No.: 10/021,396

(22) Filed: Dec. 7, 2001

(65) Prior Publication Data

US 2002/0111214 A1 Aug. 15, 2002

Related U.S. Application Data

(60) Provisional application No. 60/254,225, filed on Dec. 8, 2000.

(51) Int. Cl.
*A63F 9/24* (2006.01)

(52) U.S. Cl. ..... 463/17; 463/42

(58) Field of Classification Search ..... 463/16–22, 463/40–42; 273/269, 139

See application file for complete search history.

(56) References Cited

U.S. PATENT DOCUMENTS

| | | | |
|---|---|---|---|
| 4,494,197 | A | 1/1985 | Troy et al. |
| 4,652,998 | A | 3/1987 | Koza et al. |
| 4,677,553 | A | 6/1987 | Roberts et al. |
| 4,689,742 | A | 8/1987 | Troy et al. |
| 4,738,473 | A | 4/1988 | Meloni et al. |
| 4,764,666 | A | 8/1988 | Bergeron |
| 4,787,950 | A | 11/1988 | Meloni et al. |
| 4,850,618 | A | 7/1989 | Halladay, Jr. |
| 4,882,473 | A | 11/1989 | Bergeron et al. |
| 5,265,874 | A | 11/1993 | Dickinson et al. |
| 5,324,035 | A | 6/1994 | Morris et al. |
| 5,348,299 | A | 9/1994 | Clapper, Jr. |
| 5,377,975 | A | 1/1995 | Clapper, Jr. |
| 5,398,932 | A | 3/1995 | Eberhardt et al. |
| 5,408,417 | A | 4/1995 | Wilder |
| 5,417,424 | A | 5/1995 | Snowden et al. |
| 5,487,544 | A | 1/1996 | Clapper, Jr. |
| 5,505,449 | A | 4/1996 | Eberhardt et al. |
| 5,536,008 | A | 7/1996 | Clapper, Jr. |
| 5,580,311 | A | 12/1996 | Haste, III |
| 5,595,538 | A | 1/1997 | Haste, III |
| 5,605,504 | A | 2/1997 | Huang |
| 5,609,337 | A | 3/1997 | Clapper, Jr. |
| 5,645,485 | A | 7/1997 | Clapper, Jr. |
| 5,749,784 | A | 5/1998 | Clapper, Jr. |
| 5,772,510 | A | 6/1998 | Roberts |
| 5,787,156 | A | 7/1998 | Katz |
| 5,810,664 | A | 9/1998 | Clapper, Jr. |
| 5,928,082 | A | 7/1999 | Clapper, Jr. |

(Continued)

*Primary Examiner*—Mark Sager
(74) *Attorney, Agent, or Firm*—Russell D. Culbertson; The Culbertson Group P.C.

(57) ABSTRACT

A lottery ticket distribution system according to the invention includes a ticket distribution center (9) that is in electronic communication with a number of player terminals (10) at locations remote to the ticket distribution center. The ticket distribution center (9) includes an electronic ticket storage device (11, 20) for storing a game set (29) of electronic tickets (31) and distributing the electronic tickets to the player terminals (10). A ticket record manufacturing device (14, 15) operatively connected to the ticket distribution center (9) provides either a nonvolatile data record for each ticket or a hard copy ticket, or both. The nonvolatile data records or set of hard copy tickets for a given game set are not distributed to the players, but are held for verification and dispute resolution purposes either at the ticket distribution center (9) or some other secure location.

16 Claims, 3 Drawing Sheets

U.S. PATENT DOCUMENTS

| | | | |
|---|---|---|---|
| 5,941,771 | A | 8/1999 | Haste, III |
| 5,949,042 | A | 9/1999 | Dietz, II et al. |
| 5,980,385 | A | 11/1999 | Clapper, Jr. |
| 6,024,640 | A | 2/2000 | Walker et al. |
| 6,044,135 | A | 3/2000 | Katz |
| 6,048,269 | A | 4/2000 | Burns et al. |
| 6,056,289 | A | 5/2000 | Clapper, Jr. |
| 6,168,521 | B1 | 1/2001 | Luciano et al. |
| 6,273,820 | B1 | 8/2001 | Haste, III |
| 6,277,026 | B1 | 8/2001 | Archer |

LOTTERY TICKET DISTRIBUTION SYSTEM

CROSS-REFERENCE TO RELATED APPLICATION

This application is related to U.S. provisional patent application Ser. No. 60/254,225, filed Dec. 8, 2000 and entitled "Lottery Ticket Distribution System. " The Applicants hereby claim the benefit of this provisional patent application under 35 U.S.C. §119(e). The entire content of this provisional application is incorporated herein by this reference.

TECHNICAL FIELD OF THE INVENTION

The invention relates to gaming systems and more particularly to an apparatus and method for distributing gaming or lottery tickets from a central distribution facility to remote terminals.

BACKGROUND OF THE INVENTION

Lottery games have become popular in many jurisdictions in the United States and elsewhere. As used in this disclosure a "lottery game" is a game that is played with a set of predefined game records or tickets, each game record or ticket representing a chance in the game. Each game record or ticket is associated with a result or outcome in the game. Some results represent wins in the game and call for the player to receive cash or other prizes, while other results provide no payout.

Traditional lottery games are played with a paper lottery ticket. These lottery tickets are printed with graphics consistent with a theme of the game. The printed graphics include indicia that are correlated to a result associated with that ticket, and thus indicate the result associated with the ticket. In traditional paper lottery games, the indicia indicating the results associated with the ticket are covered or obscured until the ticket is issued to a player so that no one can determine the result associated with the ticket until after it is issued to a player. Once the player obtains the ticket, he or she may remove the cover or obscuring material to read the results of the ticket.

The paper tickets in a traditional paper ticket lottery game are distributed to sales locations in large groups of tickets commonly in the form of a continuous role of material with individual tickets separated by perforations or break lines. The tickets are randomly ordered in the group and are sold and distributed sequentially from the randomized group of tickets so that the results in the lottery game are distributed to players in a random order unknown to the players or ticket sellers. Once a player receives their paper lottery ticket, he or she may remove the cover or obscuring material and determine if the particular card has a winning or losing result.

Traditional lottery games have been implemented in electronic form in which the tickets comprise electronic data structures or data records rather than physical paper tickets. These electronic tickets normally include at least an indicator from which the result associated with the ticket may be determined and a ticket identifier. The electronic tickets, that is, the data records representing electronic tickets, are commonly grouped in data files and distributed in some random order from the file (either sequentially from a randomly ordered file or randomly from an ordered file). These electronic lottery tickets are purchased through an electronic player terminal. In the course of play, a player requests an electronic ticket or play in the game at the terminal and the results of the electronic ticket assigned to the player are displayed at the terminal.

A major advantage of electronic lottery games is that the results may be displayed in a variety of interesting formats that enhance the entertainment value of the game. Also, since paper tickets are not created or distributed, electronic lottery games avoid the costs associated with printing paper tickets and then distributing the paper tickets. Electronic lottery games also avoid the security costs associated with handling paper tickets. On the other hand, paper ticket lottery games are more familiar to players and regulators and may have a higher level of acceptance for that reason. However, both electronic lottery and traditional paper lottery games are identical in providing predetermined and readily verifiable chances of winning or losing in the game. The amounts paid out to players in the game and amounts held by the lottery operator are also predetermined.

SUMMARY OF THE INVENTION

It is an object of the invention to provide a lottery ticket distribution system that provides the desirable aspects of both traditional paper lottery games and electronic lottery games.

A lottery ticket distribution system according to the invention includes a ticket distribution center that is in electronic communication with a number of player terminals at locations remote to the ticket distribution center. The ticket distribution center includes an electronic ticket storage device for storing a game set of electronic tickets and distributing the electronic tickets to the player terminals. A ticket record manufacturing device operatively connected to the ticket distribution center provides either a nonvolatile data record for each ticket or a hard copy ticket, or both. The nonvolatile data records or set of hard copy tickets for a given game set are not distributed to the players, but are held for verification and dispute resolution purposes either at the ticket distribution center or some other secure location.

The player terminals included in the lottery ticket distribution system include a display for displaying the results associated with electronic ticket data communicated from the ticket distribution center. According to the invention, each player terminal also includes a player ticket printer for printing a player ticket with the result included in the data representing the electronic ticket. Thus, the player terminals in the present system provide a graphic display to show the player the results of a ticket in the system in an entertaining format, and also provide a hard copy ticket including a replica of a hard copy or data record held for verification purposes.

The method of distributing lottery tickets according to the invention includes storing the game set of electronic tickets at the ticket distribution center and producing the game set record preferably at the ticket distribution center. The game set includes a number of electronic lottery tickets, each represented by a collection of ticket data that includes at least a result for the respective ticket and a ticket identifier that distinguishes the ticket from others in the set. The method includes communicating the ticket data to one of the player terminals remote from the ticket distribution center. The player ticket printer at the player terminal prints the player ticket with at least a result and a ticket identifier. The player terminal also displays a representation indicating the result included with the ticket data for the respective electronic ticket. In the preferred form of the invention the player terminal first displays results and then releases the printed ticket. The player may redeem the ticket for any winnings or winnings may be awarded at the player terminal.

The lottery ticket distribution system according to the invention provides all the benefits of traditional lottery games as well as many of the benefits of electronic lottery games. The results of a play in the game may be displayed in some exciting format at the player terminal and the game may be played relatively quickly. However, the player terminals also provide players with physical paper lottery tickets that represent a replica of the previously created lottery tickets which have been stored for verification and dispute resolution purposes.

These and other objects, advantages, and features of the invention will be apparent from the following description of the preferred embodiments, considered along with the accompanying drawings.

DESCRIPTION OF THE PREFERRED EMBODIMENTS

Figure 1:
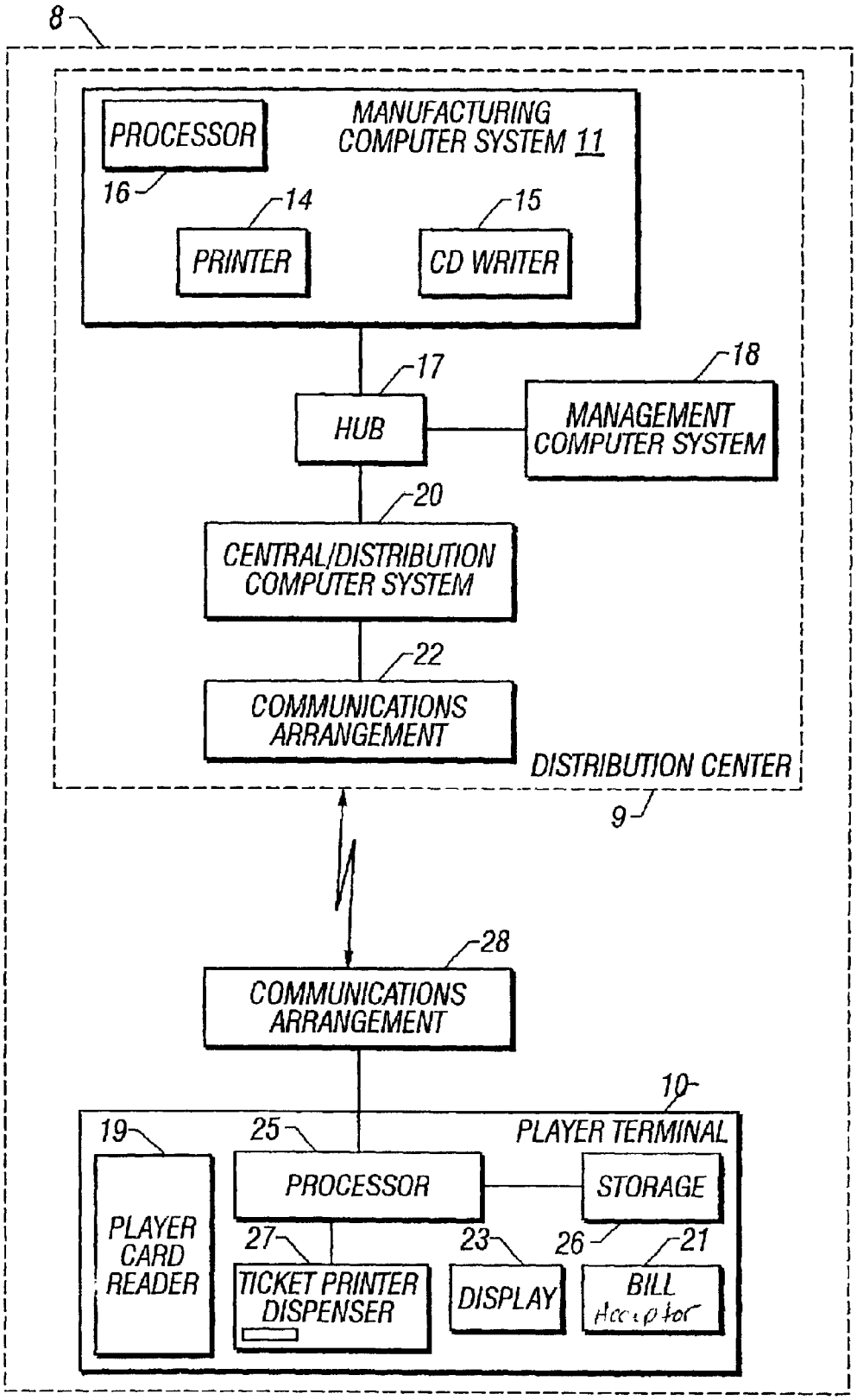
FIG. 1 is a diagrammatic representation of a lottery ticket distribution system embodying the principles of the invention.

Referring to FIG. 1 a lottery ticket distribution system 8 according to the invention includes a distribution center or ticket distribution center shown generally at reference numeral 9 and at least one, and preferably many, player terminals 10. As will be discussed in detail below, distribution center 9 creates electronic lottery tickets, a hard copy or printed copy of each electronic ticket, and/or a nonvolatile data record for each electronic ticket. The hard copy tickets and nonvolatile data record are not distributed according to the invention but are stored at a secure location for reference or reconciliation purposes. Only the electronic lottery tickets are distributed to players from distribution center 9.

The electronic lottery tickets are distributed over a secure communications arrangement to remote player terminals such as player terminal 10 where the individual lottery tickets may be purchased. According to the invention, the electronic lottery tickets are distributed to player terminal 10 and then printed at a printing device at the player terminal as a replica of the corresponding hard copy lottery ticket held at the secure location. "Replica" in this sense means that the hard copy ticket record printed at the player terminal 10 shows the outcome of the electronic lottery ticket along with sufficient identifying information to uniquely associate the remotely printed ticket record with both the corresponding electronic lottery ticket record and the hard copy record printed at the distribution center.

Distribution center 9 includes a manufacturing computer system 11 connected to communicate with a management computer 18 and a central computer 20. A local area network hub 17 is shown connecting the manufacturing computer 11, management computer 18, and central computer 20 for communications between the respective computers.

Manufacturing computer 11 includes a ticket record manufacturing device comprising ticket printer 14 for printing the hard copy representations of the electronic lottery tickets, that is, each game set of tickets manufactured at the manufacturing computer. An additional ticket record manufacturing device comprising CD writer 15 is also operatively connected to the manufacturing computer 11 to allow the manufacturing computer to store a large number of data records or electronic tickets on a CD or optical disk. Other types of nonvolatile data storage media may be used alternatively to an optical disk and thus the manufacturing computer may include some alternative device rather than a CD writer. Also, alternate forms of the invention may include only printer 14 or only nonvolatile data storage device 15, but not both. It will be appreciated that manufacturing computer system 11 also includes a processor 16 with associated random access memory and other computer system components which are not shown in the drawing.

Management computer 18 communicates with both the manufacturing computer 11 and central computer 20 for producing system management and maintenance reports and other materials. Although not shown in the drawing, it will be appreciated that management computer 18 includes a display, suitable user interface, and perhaps a printer for printing the desired reports.

Central computer 20 receives electronic lottery tickets from manufacturing computer 11 and stores the electronic tickets until a ticket or a number of tickets are requested from a player terminal 10. When requested by a player terminal 10, the electronic tickets are communicated to the requesting terminal through communications arrangement 22. Further details of the operation of central computer 20 will be described with reference to the flowchart shown in FIG. 3.

Although the form of the lottery ticket distribution system 8 shown in FIG. 1 shows manufacturing computer 11, management computer 18, and central computer 20 as separate processing devices, it will be appreciated that a single processing device may be used to perform the functions required of the distribution center 9. Alternatively, the processes required at distribution center 9 may be distributed differently among a different arrangement or architecture of computer systems. For example, management functions may be implemented through the same computer used to manufacture the electronic lottery tickets, or implemented through central computer system 20.

Each player terminal 10 includes a computer having a processor 25, a data storage device 26, a player ticket printer or dispenser 27, and preferably a game video display 23. A coin or bill acceptor 21 may be included in player terminal 10 if players are allowed to purchase lottery chances at the player terminal without any interaction with a cashier or attendant. Each player terminal 10 also includes a communications arrangement 28. Communications arrangement 28 is adapted to cooperate with communications arrangement 22 located at the distribution center 9 to provide the required data transmissions between the distribution center and player terminal 10. If the lottery game played through system 8 is implemented as a cashless electronic lottery game, each player terminal 10 may also include a player account card reader or account identifier entry device 19.

Communications between distribution center 9 and player terminals 10 may be accomplished in any suitable and secure manner. Regardless of the medium used for communicating the data, the data communicated between distribution center 9 and player terminals 10 are preferably encrypted to help prevent unauthorized access to the data. The communication medium may comprise an electronic medium dedicated for the communications such as a dedicated network, or may comprise a public network such as the Internet. Alternatively, communications between distribution center 9 and player terminals 10 may be through wireless communications. Any arrangement in which data may be transferred from one point to another may be used within the scope of the present invention for communications between distribution center 9 and player terminals 10.

Figure 2:
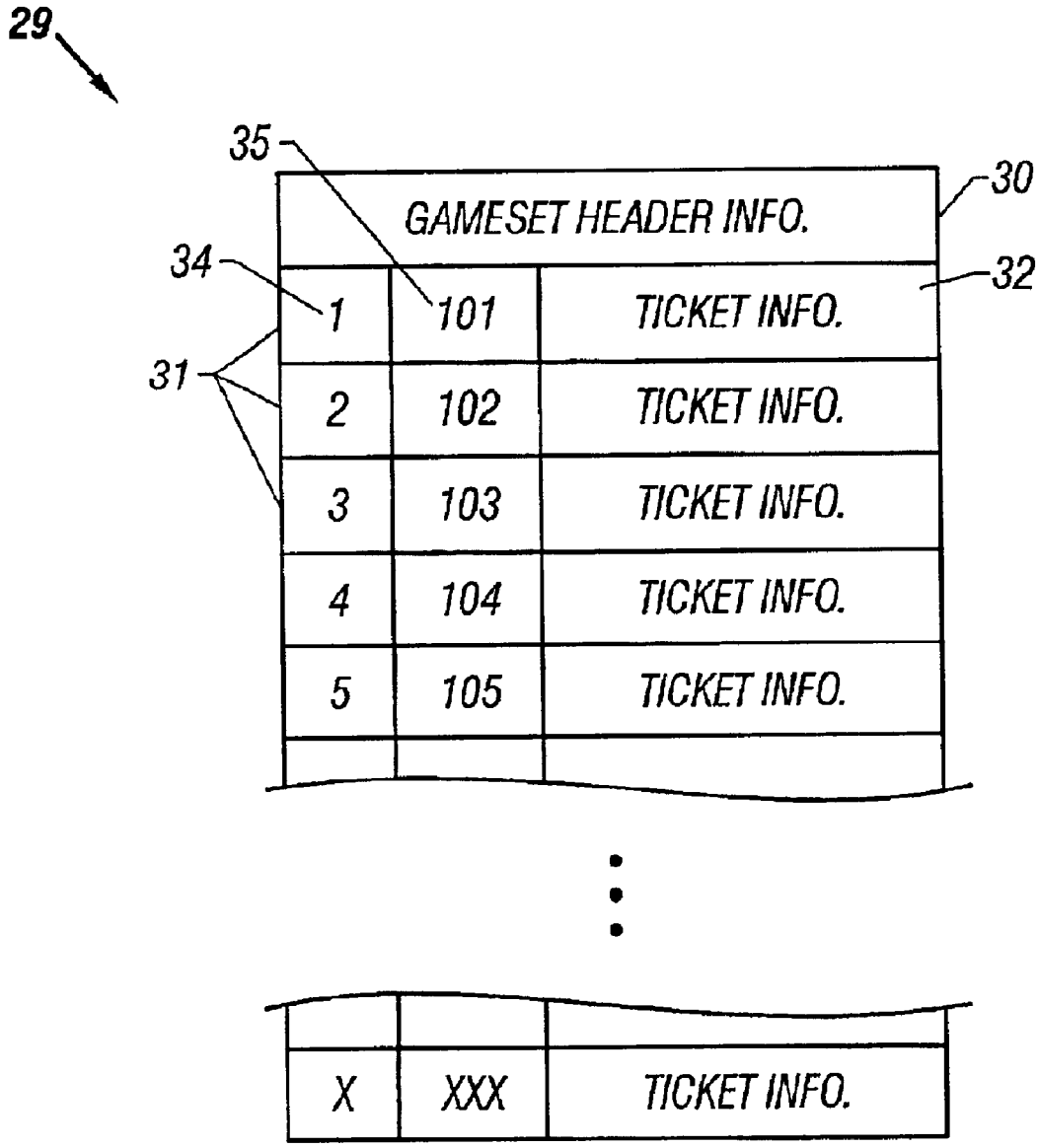
FIG. 2 is a diagrammatic representation of an electronic lottery ticket game set used according to the invention.

Referring to FIG. 2, electronic lottery tickets according to the invention are preferably created in groups which may be referred to as game sets. The preferred game set 29 of electronic lottery tickets includes a game set header 30 including game set identifying information such as a game serial number, game set serial number, game name, and other game set identifying information (not shown). In addition to the game set header, each game set 29 includes a number of electronic ticket records 31. Each separate record represents an electronic lottery ticket and includes identifying information along with ticket outcome information 32. Outcome information 32 preferably comprises a code or index that represents a certain outcome in the particular lottery game, and may further include an outcome value. The identifying information may include a sequence identifier 34 identifying the order of the particular record in the game set, and a record serial number 35 which uniquely identifies the respective record/electronic ticket in the game set 29.

Figure 3:
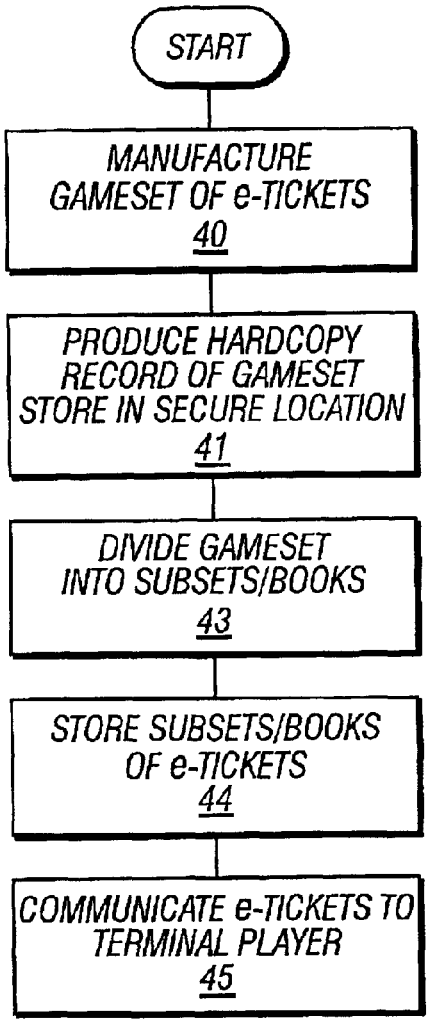
FIG. 3 is a flowchart showing the process steps performed at the distribution center shown in FIG. 1.

As indicated in FIG. 3, the process employed by lottery ticket distribution system 8 (FIG. 1) includes the step of manufacturing at least one game set of electronic tickets as shown at process block 40. Each game set preferably includes structure set out in FIG. 2 and is manufactured in some suitable fashion at manufacturing computer 11 shown in FIG. 1. Once the game set is manufactured, the present lottery ticket distribution process includes producing a game set record comprising either a hard copy record of the game set or a nonvolatile, preferably read-only, data record of the game set, or both the hard copy record and data record as indicated at process block 41. The hard copy record preferably comprises a number of printed tickets representing the electronic tickets or ticket records 31 and may be printed at printer 14 associated with manufacturing computer 11. The preferred data storage medium for the data record comprises a CD or similar optical medium. Each game set record that is, the set of hard copy printed tickets and/or set of data records for each game set is stored at a secure location and are used only for reconciliation and dispute resolution purposes.

Once the hard copy and/or data record are created at step 41, of the method may include dividing the game set into a number of subsets or "books" of electronic tickets as shown at step 43. Each of these subsets also preferably includes header information identifying the respective game set from which the subset is created and distinguishing the subset from others. Whether the game sets are divided into subsets of electronic tickets or not, the electronic tickets are stored at step 44, and are made available to be communicated to a player terminal 10 upon a request issued from the respective terminal. Storing the electronic tickets as shown at step 44 in FIG. 3 may be performed at manufacturing computer 11 or at central computer 20. In the preferred form of the invention, the entire game set is stored at manufacturing computer 11 and subsets of electronic game tickets are transferred as necessary to central computer 20.

The step of communicating the electronic tickets to the player terminals 10 shown at process block 45 may include communicating individual electronic tickets, or subsets of electronic tickets for storage at the player terminals. Where a number of electronic tickets are stored at a player terminal 10 in FIG. 1, the player terminal includes operational software for identifying when it needs a new supply of electronic tickets and automatically requesting additional tickets from distribution center 9.

Figure 4:
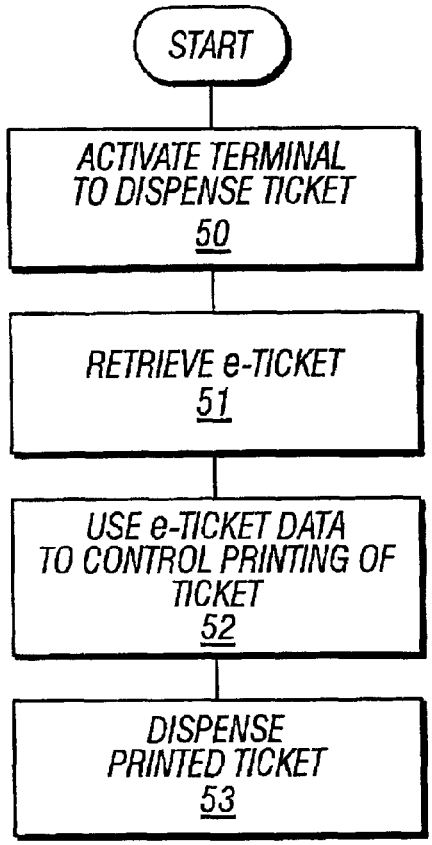
FIG. 4 is a flowchart showing the process steps performed at the player terminal shown in FIG. 1.

Referring to FIG. 4, the process controlled by operational software executed at each player terminal 10 includes the step of activating the terminal to dispense a ticket as shown at block 50. This activation step may be performed manually by a cashier or attendant after receiving a payment from a lottery ticket buyer. Alternatively, the player terminals may include a bill or coin acceptor for receiving cash from a player and activating to dispense a ticket in response to the received payment. As a further alternative, a player terminal 10 may be activated to dispense a ticket when a player enters a valid account number or identifier at the player terminal by suitable means. In this alternative process for activating player terminal 10 for dispensing one or more tickets, the player would have a previously established account preferably maintained at a database (not shown) associated with distribution center 9. Operational software at the player terminal communicates the player's account identifier to the distribution center 9 for determining whether the player's account is valid. If operational software executed at distribution center 9 finds from the stored account information that the player's account is valid, the distribution center communicates with the player terminal to indicate that the account is valid. The player terminal 10 responds to this valid account indicator by either dispensing an electronic ticket immediately to dispensing the ticket upon a play request or other input from the player at the player terminal.

Once player terminal 10 shown in FIG. 1 is activated to dispense a ticket, the terminal either retrieves an electronic ticket from its storage 26 or communicates with distribution center 9 to retrieve a new electronic ticket as indicated at process block 51. At process block 52, the player terminal then uses data in the retrieved electronic ticket to control the printing of a hard copy "distributed" ticket using ticket printer 27 at player terminal 10. This hard copy, distributed ticket preferably comprises a replica of the hard copy ticket record printed at distribution center 9 and stored at the secure location as described above. The distributed hard copy ticket is eventually dispensed at player terminal 10 as indicated at process block 53, to be taken by the player.

The hard copy ticket created at the player terminals 10 may be created any of a number of different formats. Each hard copy ticket will include a serial number or other unique identifying indicia which identifies the hard copy ticket record with a particular electronic ticket record. This identifying information may be printed on the hard copy ticket or encoded onto a suitable medium such as a mag stripe on the ticket, or both. The hard copy ticket will also include some indicia or code showing the outcome of the electronic ticket that has been distributed from the distribution center and perhaps a prize value. In some forms of the invention the outcome and prize value may be printed so as to be immediately viewable by the player without having to remove any cover or obscuring material. In other forms of the invention, the outcome and prize value may be obscured from view and available for view only after removing some obscuring material or cover included on or with the ticket.

Regardless of the form of the printed lottery ticket distributed from player terminals 10, the player terminal preferably operates under the control of software to create some appropriate display at the display 23. For example, player terminal display 23 may respond to the information included with the received electronic lottery ticket to display a result in a reel-type game such as a slot machine. The display preferably begins by showing a representation of spinning reels as soon as the player enters a request for an electronic lottery ticket through the player terminal 10. Once the player terminal has retrieved the particular electronic lottery ticket, it can use the information included in the electronic ticket record to show the video representation of reels stopping in a condition consistent with the outcome included in the electronic ticket. It will be appreciated that the player terminals 10 may imitate other types of games including other traditional casino games such as poker or blackjack.

The printed ticket is dispensed from player ticket printer/dispenser 27 shown in FIG. 1. In some forms of the invention, the player may redeem a winning ticket by going to a cashier or other entity authorized to redeem tickets purchased through the present distribution system. In other forms of the invention, the printed ticket dispensed from player terminal 10 is not redeemable itself but comprises a receipt or printed record of the lottery game played at the player terminal. In either case, a single piece of media distributed from the player terminal may be printed with more than one and perhaps numerous individual hard copy ticket records each corresponding to a different electronic ticket which has been purchased by the player through the player terminal 10. The single ticket card or media in this form of the invention is thus retained in the ticket printer/dispenser 27 shown in FIG. 1 until the player is finished making requests for lottery tickets at the player terminal 10. When the player is finished at the particular terminal 10 and produces an end play signal by the removal of a player card from account card reader 19 or activation of a suitable control at the player terminal, ticket printer/dispenser 27 completes the printing step and dispenses the resulting ticket media. Actual printing on the hard copy ticket media may be done by printer/dispenser 27 in response to the receipt of each respective electronic lottery ticket either from the distribution center 9 directly or from a supply stored locally or otherwise and printed when the player is finished at the respective player terminal 10. The result indicating representation is preferably displayed at the player terminal before the player ticket for that play is issued at the player terminal.

The lottery ticket distribution system 8 according to the invention allows lottery tickets having a predetermined outcome to be distributed securely in an electronic form without having to distribute preprinted tickets to player locations. The hard copy tickets printed at the remote player terminals 10 may be redeemed like regular scratch-off lottery tickets or used as a receipt or record of play in a cashless electronic lottery-type gaming system.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A lottery ticket distribution system including:

(a) a ticket distribution center including an electronic ticket storage device for storing a game set comprising a number of electronic lottery tickets to be distributed to players using the system, each electronic lottery ticket being represented by ticket data that includes at least a result and a ticket identifier associated with the respective electronic lottery ticket;

(b) a ticket record manufacturing device operatively connected with the ticket distribution center and located at a secure location inaccessible to the players, the ticket record manufacturing device for producing a non-volatile data record or a hard copy ticket record for each respective electronic lottery ticket in the game set prior to a ticket request corresponding to the respective electronic lottery ticket, the ticket record manufacturing device also being distinct from the electronic ticket storage device;

(c) a player terminal for receiving from the ticket distribution center the ticket data representing one of the electronic lottery tickets, the player terminal residing at a location remote from the ticket distribution center;

(d) a player ticket printer included with the player terminal, the player ticket printer for printing a player ticket with the result and a ticket identifier included in the respective ticket data; and (e) a communications arrangement for facilitating data communications between the ticket distribution center and the player terminal.

2. The system of claim 1 wherein the ticket record manufacturing device comprises a hard copy printer that produces the hard copy ticket record for each electronic lottery ticket in the game set.

3. The system of claim 1 wherein the ticket record storage manufacturing device comprises an optical disc writer that produces the non-volatile data record for each electronic lottery ticket in the game set.

4. The system of claim 1 further including a display operatively connected to the player terminal for displaying the result included in the respective ticket data in response to a player input at the player terminal.

5. The system of claim 1 wherein the ticket distribution center includes a manufacturing computer for manufacturing the game set.

6. A method for distributing lottery tickets, the method including the steps of:

(a) at a ticket distribution center, storing a game set comprising a number of electronic lottery tickets to be distributed to players using the system, each electronic lottery ticket being represented by a respective collection of ticket data that includes at least a result and a ticket identifier associated with the respective electronic lottery ticket;

(b) prior to a ticket request for any electronic lottery ticket in the game set at the distribution center, producing a game set record at a secure location and securing the game set record from access by the players, the game set record comprising a set of non-volatile data records including a respective data record for each respective electronic lottery ticket in the game set or comprising a set of hard copy ticket records including a respective hard copy ticket record for each respective electronic lottery ticket in the game set;

(c) communicating the ticket data representing one of the electronic lottery tickets over a communications arrangement from the ticket distribution center to a player terminal at a location remote from the ticket distribution center; and (d) at the player terminal location, printing a player ticket with the result and ticket identifier included in the respective ticket data communicated from the ticket distribution center to the player terminal.

7. The method of claim 6 further including the step of generating the game set at the ticket distribution center.

8. The method of claim 6 wherein the step of communicating the ticket data representing one of the electronic lottery tickets is performed in response to a player input at the player terminal.

9. The method of claim 6 further including the step of storing the respective ticket data while different ticket data representative of a different one of the electronic lottery tickets is printed on a different player ticket in response to a play request entered through the player terminal.

10. The method of claim 6 further including the step of storing the respective ticket data while different ticket data representative of a different one of the electronic lottery tickets is printed on the player ticket in response to a play request entered through the player terminal.

11. The method of claim 6 further including the steps of:

(a) communicating different additional ticket data representing a different one of the electronic lottery tickets over the communications arrangement from the ticket distribution center to the player terminal;

(b) at the player terminal location, printing the player ticket with the result included in the additional ticket data; and (c) at the player terminal location, displaying a representation indicating the result included in the additional ticket data.

12. The method of claim 11 further including the step of ejecting the player ticket in response to an end play signal.

13. A lottery ticket distribution system including:

(a) a ticket distribution center including an electronic ticket storage device for storing a game set comprising a number of electronic lottery tickets to be distributed to players using the system, each electronic lottery ticket being represented by respective ticket data;

(b) a ticket record manufacturing device operatively connected with the ticket distribution center and located at a secure location inaccessible to the players, the ticket record manufacturing device for producing a hard copy ticket record for each respective electronic lottery ticket in the game set prior to a ticket request corresponding to the respective electronic lottery ticket, the ticket record manufacturing device also being distinct from the electronic ticket storage device;

(c) a player terminal for receiving from the ticket distribution center the ticket data representing one of the electronic lottery tickets, the player terminal residing at a location remote from the ticket distribution center;

(d) a player ticket printer included with the player terminal, the player ticket printer for printing a replica of the hard copy ticket record for a respective electronic lottery ticket; and (e) a communications arrangement for facilitating data communications between the ticket distribution center and the player terminal.

14. The system of claim 13 further including a display operatively connected to the player terminal for displaying the result included in the respective ticket data in response to a player input at the player terminal.

15. The system of claim 13 wherein the ticket distribution center includes a manufacturing computer for manufacturing the game set.

16. The system of claim 13 wherein the ticket record manufacturing device produces the respective hard copy ticket record for the respective electronic lottery ticket in the game set prior to the distribution of any of the electronic lottery tickets in the game set from the ticket distribution center.

* * * * *

UNITED STATES PATENT AND TRADEMARK OFFICE

CERTIFICATE OF CORRECTION

PATENT NO. : 6,991,541 B2
DATED : January 31, 2006
INVENTOR(S) : Clifton Lind et al.

It is certified that error appears in the above-identified patent and that said Letters Patent is hereby corrected as shown below:

Column 5,
Line 41, change "Each game set record that" to -- Each game set record, that --.

Column 8,
Line 23, change "ticket record storage" to -- ticket record --.

Column 9,
Line 12, change "communicating different additional" to -- communicating additional --.

Signed and Sealed this

Twenty-eighth Day of March, 2006

JON W. DUDAS
*Director of the United States Patent and Trademark Office*